United States Patent [19]

Jacobs et al.

[11] Patent Number: 4,878,962

[45] Date of Patent: Nov. 7, 1989

[54] TREATMENT FOR INHIBITING IRRADIATION INDUCED STRESS CORROSION CRACKING IN AUSTENITIC STAINLESS STEEL

[75] Inventors: Alvin J. Jacobs, San Jose; Gerald M. Gordon, Soquel, both of Calif.

[73] Assignee: General Electric Company, San Jose, Calif.

[21] Appl. No.: 206,144

[22] Filed: Jun. 13, 1988

[51] Int. Cl.[4] ..... C21B 6/00

[52] U.S. Cl. ..... 148/136; 148/135

[58] Field of Search ..... 148/136, 134, 135, 13, 148/13.1, 327, 419, 410, 442; 420/43, 584, 586.1, 452, 453; 376/900

[56] References Cited

U.S. PATENT DOCUMENTS

| | | | |
|---|---|---|---|
| 1,807,453 | 5/1931 | Tielke | 148/325 |
| 2,888,373 | 5/1959 | Cherrie et al. | 148/21.54 |
| 3,052,576 | 9/1962 | Josso | 148/120 |
| 3,131,055 | 4/1964 | Behar | 148/12.3 |
| 3,384,476 | 5/1968 | Egnell | 420/584 |
| 3,649,251 | 3/1972 | Larson, Jr. et al. | 420/584 |
| 3,873,378 | 3/1975 | Webster | 148/325 |
| 3,957,545 | 5/1976 | Mimino et al. | 148/136 |
| 4,086,107 | 4/1978 | Tanino et al. | 148/136 |
| 4,353,755 | 10/1982 | Solomon | 148/136 |
| 4,576,641 | 3/1986 | Bates et al. | 148/327 |
| 4,778,651 | 10/1988 | Dubuisson et al. | 148/327 |

*Primary Examiner*—Deborah Yee

*Attorney, Agent, or Firm*—Robert R. Schroeder; Raymond G. Simkins

[57] ABSTRACT

A heat treatment method for inhibiting irradiation induced stress corrosion cracking in stainless steel and related nickel-chromium alloys.

6 Claims, 3 Drawing Sheets

TREATMENT FOR INHIBITING IRRADIATION INDUCED STRESS CORROSION CRACKING IN AUSTENITIC STAINLESS STEEL

FIELD OF THE INVENTION

This invention relates to austenitic stainless steel and high nickel-chromium alloys which are employed in environments of high irradiation such as in the interior of a nuclear fission reactor. The invention is concerned with the failure of stainless steel and other alloys commonly utilized within and about nuclear reactors due to the occurrence of stress corrosion cracking resulting mainly from their exposure to high levels of irradiation.

BACKGROUND OF THE INVENTION

Stainless steel alloys of high chromium-nickel type are commonly used for components employed in nuclear fission reactors due to their well known high resistance to corrosive and other aggressive conditions. For example, nuclear fuel assemblies, neutron absorbing control devices, and neutron source holders are frequently clad or contained within a sheath or housing of stainless steel of Type 304, or similar alloy compositions. Frequently such components, including those mentioned, are located in and about the core of fissionable fuel of a nuclear reactor where the extremely aggressive conditions such as high radiation and temperatures are the most rigorous and debilitating.

Commercial solution or mill annealed stainless steel alloys are generally considered to be essentially immune to intergranular stress corrosion cracking, among other sources of deterioration and in turn failure. However, stainless steels have been found to degrade and fail due to intergranular stress corrosion cracking following exposure to high irradiation such as is typically encountered in service within and about the fissionable fuel core of water cooled nuclear fission reactors. Such irradiation related intergranular stress corrosion cracking failures have occurred notwithstanding the stainless steel alloy having been in the so-called solution or mill annealed condition; namely having been treated by heating up to within a temperature range of about 1,850°to 2,050° F., then rapidly cooled as a means of solutionizing carbides and then deterring their nucleation and precipitation from solution out into grain boundaries.

It is theorized that high levels of irradiation resulting from a concentrated field or extensive exposure, or both, are a significantly contributing cause of such degradation of stainless steel alloys, due among other possible factors to the irradiation promoting segregation of the impurity contents of the alloy.

Past efforts to mitigate irradiation related intergranular stress corrosion cracking in stainless steel alloys comprise the development of resistant alloy compositions. For example, stainless steels containing low levels of impurities have been proposed.

SUMMARY OF THE INVENTION

This invention comprises a method of treating austenitic stainless steel alloy compositions of the high chromium-nickel type and similar alloys, and items or devices constructed thereof, which inhibits the possible future occurrence of stress corrosion cracking therein resulting from high levels of and/or prolonged exposure to irradiation. The preventative treatment comprises a precise thermal treatment procedure, or enhanced solution annealing step, which imparts to such alloys a high degree of resistance to stress corrosion cracking although subjected to concentrated irradiation.

OBJECTS OF THE INVENTION

It is a primary object of this invention to provide a means of inhibiting the occurrence of stress corrosion cracking in austenitic stainless steel and other high nickel-chromium alloys, and articles formed therefrom, which is attributable to exposure to irradiation.

It is also an object of this invention to provide an effective and feasible treatment for imparting resistance to irradiation promoted stress corrosion cracking in austenitic stainless steel alloys and products produced therefrom, which are subjected to concentrated irradiation.

It is a further object of this invention to provide an economical and practical method for inhibiting the failure of austenitic stainless steel components for service in nuclear reactors and other manufactured articles of stainless steel subjected to high irradiation due to stress corrosion cracking.

It is an additional object of this invention to provide an effective method for dealing with the problem of stress corrosion cracking in austenitic stainless steel alloys following exposure to irradiation that does not entail any adverse effects upon the alloy or products therefrom.

DETAILED DESCRIPTION OF THE INVENTION

Figure 1:
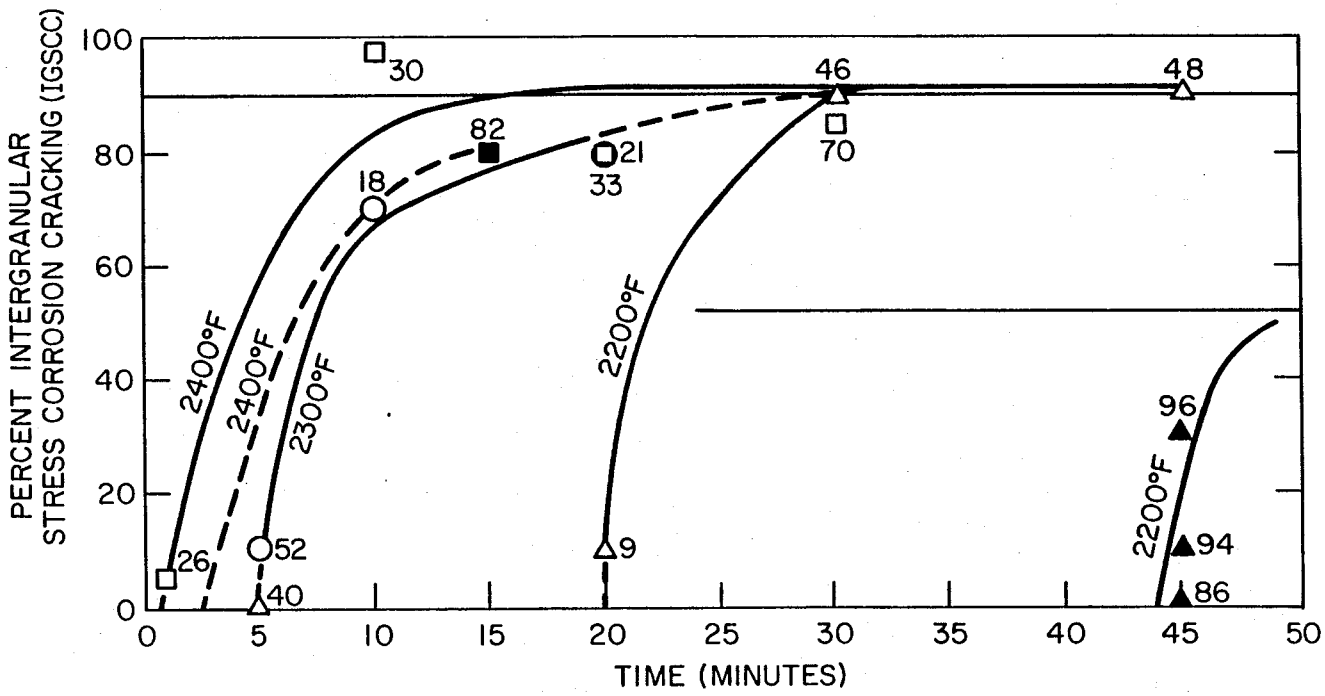
FIG. 1 of the drawing comprises a graph showing the various stress corrosion susceptibilities of stainless steel in relation to temperatures and time periods thereof of differing levels of heat treatments.

This invention is primarily concerned with structural units and articles, or components thereof, which are manufactured from, or include austenitic stainless steel such as Type 304, and are designated for service in the radioactive environment of a nuclear fission reactor or other radiation related devices or environments. The invention is particularly directed to a preventative measure for impeding the occurrence of radiation induced degradation of austenitic stainless steel which is employed in such service, including single phase austenitic stainless steels.

This invention further applies to austenitic, high nickel content with chromium alloys comprising about 30 to about 76 percent weight of nickel with minor amounts of chromium of about 15 to about 24 percent weight, such as the commercial Incoloy and Inconel series of products.

This invention is specifically directed to a potential deficiency of susceptibility to irradiation degradation which may be encountered with chromiumnickel austenitic stainless steels comprising both commercial purity and high purity Type 304. Commercial Type 304 stainless steel alloy is specified in Tables 5-4 on pages 5-12 and 5-13 of the 1958 edition of the *Engineering Materials Handbook*, edited by C. L. Mantell. Typically, such an alloy comprises about 18 to 20 percent weight of chromium and about 8 to 14 percent weight of nickel, with up to a maximum of percent weight of 0.08 carbon, 2.0 manganese, 1.0 silicon and 3.0 molybdenum, and the balance iron with some insignificant amounts of incidental impurities.

Components such as fuel and absorber rod containers, neutron source retainers comprising austenitic stainless steel alloys of the foregoing type, which are employed in the fuel core of nuclear fission reactors, occasionally fail due to a phenomenon referred to as "irradiation-assisted stress corrosion cracking." This type of deterioration is a unique form of stress corrosion cracking which can occur although the stainless steel alloy has been solution or mill annealed. Stainless steels which has been subjected to the conventional solution or mill annealing temperatures of 1850° to 2050° F. are considered in the industry to be immune to the occurrence of intergranular stress corrosion cracking. However, when such treated stainless steel alloys are subjected to high levels of radiation such as typically encountered within and about the fuel core of a nuclear reactor, the high irradiation field performs some complex role in assisting the occurrence of intergranular stress corrosion cracking. It has been theorized that a possible mechanism or cause of such a phenomenon is that the irradiation promotes the segregation of impurities within the alloy, such as phosphorus, sulfur, silicon and nitrogen, to its grain boundaries.

This invention comprises a preventative heat treatment of precise conditions of temperature and time of exposure thereto which markedly diminishes the commonly manifested adverse influence or role of irradiation upon austenitic stainless steel alloys, and its deleterious effects in contributing to the occurrence of intergranular stress corrosion cracking of such alloys. The method of this invention comprises the specific step of subjecting the austenitic stainless steel alloy to a temperature of at least 2050° F. (1121° C.) up to about 2400° F. (1316° C.) over a period of at least one minute up to about 45 minutes. The period of time for maintaining such temperatures should be approximately inversely proportional to the temperature within the range. For example, relatively longer periods of time should be used with temperatures in the lower region of the given range, and conversely, shorter periods are suitable for the temperatures in the higher region of the range of conditions for effective practice of the invention.

Preferably, the method of deterring the occurrence of irradiation assisted stress corrosion cracking comprises maintaining the austenitic stainless steel alloy at a temperature within the approximate optimum range of 2200° to 2400° F. for a relatively brief period about 5 minutes to about 20 minutes. As will be apparent from the examples, the allowable period of exposure to the temperature conditions is typically briefer to achieve effective corrosion resistance for the commercially pure grade of Type 304 stainless steel than for the high purity grade of the same alloy.

The specific temperature and time conditions of the treatment method of this invention effectively inhibit irradiation assisted stress corrosion cracking as well as the common intergranular stress corrosion cracking attributed to sensitization. The mitigating effect of the temperature/time for the solution annealing treatment of the invention appear to be the result of more effective desorption of alloy grain boundary impurities.

The following evaluating tests serve as specific examples for the practice of this invention as well as demonstrating the markedly inhibiting effects of the invention in decreasing the occurrence of intergranular stress corrosion cracking in austenitic stainless steel alloys which is attributable to high irradiation exposure.

Compositions of the stainless steel alloys evaluated for stress corrosion cracking susceptibility were as follows:

TABLE 1

| Heat No. | Composition of Type 304 Stainless Steel Heats Weight (%) Cr | Ni | C | Si | Mn | P | S | N | B |
|---|---|---|---|---|---|---|---|---|---|
| 10103 | 18.30 | 9.75 | 0.015 | 0.05 | 1.32 | 0.005 | 0.005 | 0.08 | <0.001 |
| 22092 | 18.58 | 9.44 | 0.017 | 0.02 | 1.22 | 0.002 | 0.003 | 0.037 | 0.0002 |
| 447990 | 18.85 | 8.78 | 0.054 | 0.48 | 1.56 | 0.030 | 0.013 | 0.087 | — |
| 21770 | 18.60 | 8.13 | 0.040 | 0.61 | 1.75 | 0.026 | 0.010 | 0.080 | — |

The stainless steel alloy test specimens were each prepared for evaluation by first subjecting each to a solution annealing heat treatment as specified hereinafter, including conditions within the scope of this invention and beyond, then all were irradiated in a nuclear reactor to a range of fast neutron fluences from $2.22\times10^{21}$ n/cm$^2$ to $3.08\times10^{21}$ n/cm$^2$ (E>1MeV), at a temperature of 550° F. The extent of intergranular stress corrosion observed with a scanning electron microscope on the fractured surface of the irradiated test specimens was used as a measure of the irradiation assisted stress corrosion cracking phenomenon.

The temperatures and times applied of the heat treatment conditions applied to the test specimens are given in the following Table 2:

TABLE 2

| Grade of Stainless Steel | Sample Number | Heat Number | Solution Heat Treatment (F/min.) | Fast (E>1 MeV) Neutron Fluence ($\times 10^{21}$ n/cm$^2$) |
|---|---|---|---|---|
| Commercial-Purity | 1 | 447990 | Mill Annealed | 3.08 |
| | 2 | 447990 | 2200/45 | 2.58 |
| | 3 | 447990 | 2200/30 | 2.58 |
| | 4 | 21770 | 2200/20 | 2.99 |
| | 5 | 447990 | 2200/05 | 3.08 |
| | 6 | 21770 | 2300/20 | 2.99 |
| | 7 | 21770 | 2300/10 | 3.06 |
| | 8 | 447990 | 2300/05 | 3.08 |
| | 9 | 447990 | 2400/30 | 2.58 |
| | 10 | 21770 | 2400/20 | 2.99 |
| | 11 | 21770 | 2400/10 | 3.06 |

Compositions and Heat Treatments of Irradiated Type 304 Stainless Steel Samples

TABLE 2-continued

Compositions and Heat Treatments of Irradiated Type 304 Stainless Steel Samples

| Grade of Stainless Steel | Sample Number | Heat Number | Solution Heat Treatment (F/min.) | Fast (E>1 MeV) Neutron Fluence ($\times 10^{21}$ n/cm$^2$) |
|---|---|---|---|---|
| | 12 | 21770 | 2400/01 | 2.80 |
| High Purity | 13 | 10103 | Mill Annealed | 2.80 |
| | 14 | 22092 | Mill Annealed | 2.22 |
| | 15 | 10103 | Mill Annealed | 2.22 |
| | 16 | 10103 | 2200/45 | 2.60 |
| | 17 | 10103 | 2200/45 | 2.80 |
| | 18 | 22092 | 2400/15 | 3.01 |

The stress corrosion test results of the test specimens, in relation to the temperatures and times applied in the heat treatments, are shown in the graph of FIG. 1. It is apparent from the data of FIG. 1 that the irradiation assisted stress corrosion cracking (as measured by percent intergranular stress corrosion cracking) can be reduced from about 90 percent cracking in commercial purity, mill annealed Type 304 stainless steel down to about 0 percent cracking by subjecting the alloy to a temperature of 2200° F. for about 20 minutes, or to a temperature of 2300° F. for about 5 minutes, or a temperature of 2400° F. for about 1 minute. Moreover, irradiation assisted stress corrosion cracking can be reduced from about 50 percent cracking in high purity, mill annealed Type 304 stainless steel to about 0 percent cracking by subjecting the alloy to a temperature of 2200° F. for about 45 minutes.

It is noteworthy that, as shown in FIG. 1, there are clear maximum heating times for effective treatment; for instance, longer heating times than one minute at 2400° F. for commercial purity Type 304 stainless steel do not fully eliminate irradiation assisted stress corrosion cracking. Rather corrosion cracking appears to increase with increasing periods of heating, whereby about one minute is an approximate maximum heating period at 2400° F. for commercial purity Type 304 stainless steel.

Figure 2:
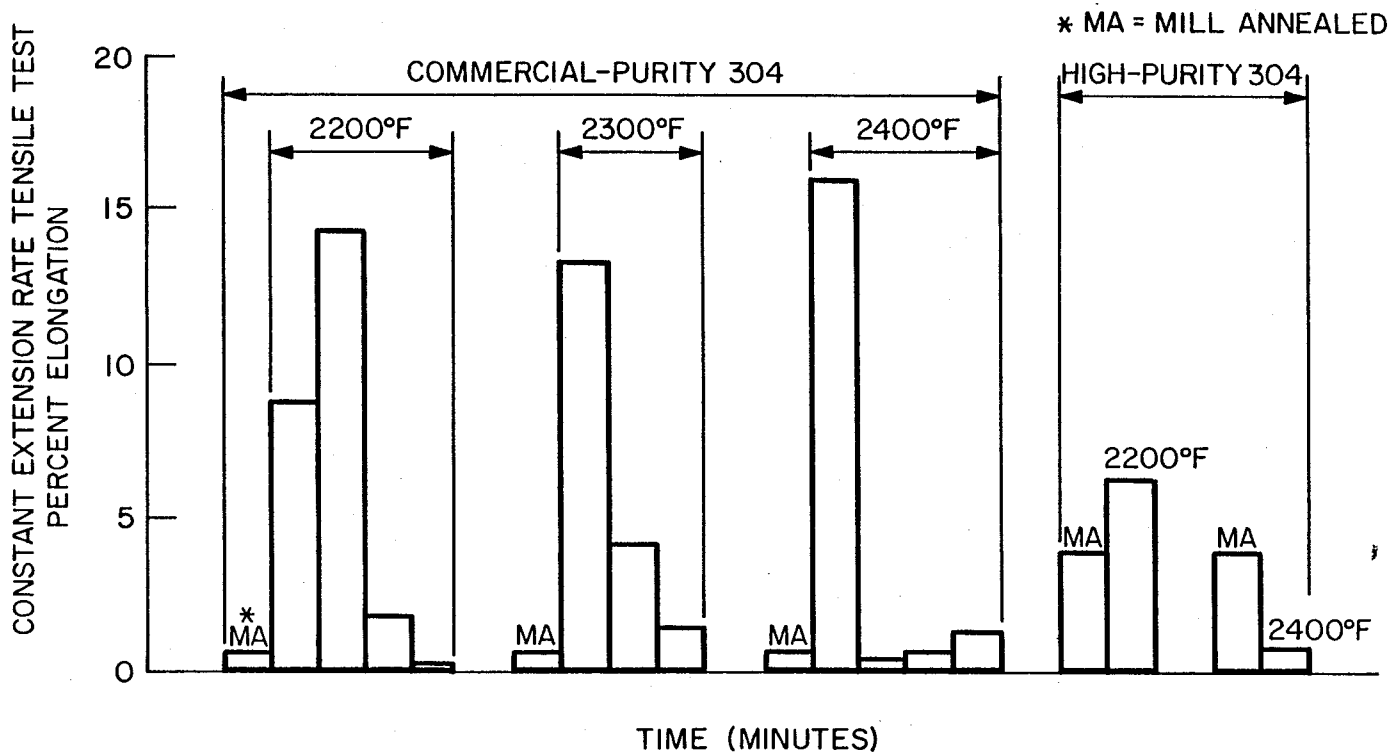
FIG. 2 of the drawing comprises a bar graph showing the relative elongation of stainless steel subjected to the heat treatment of the invention.
Figure 3:
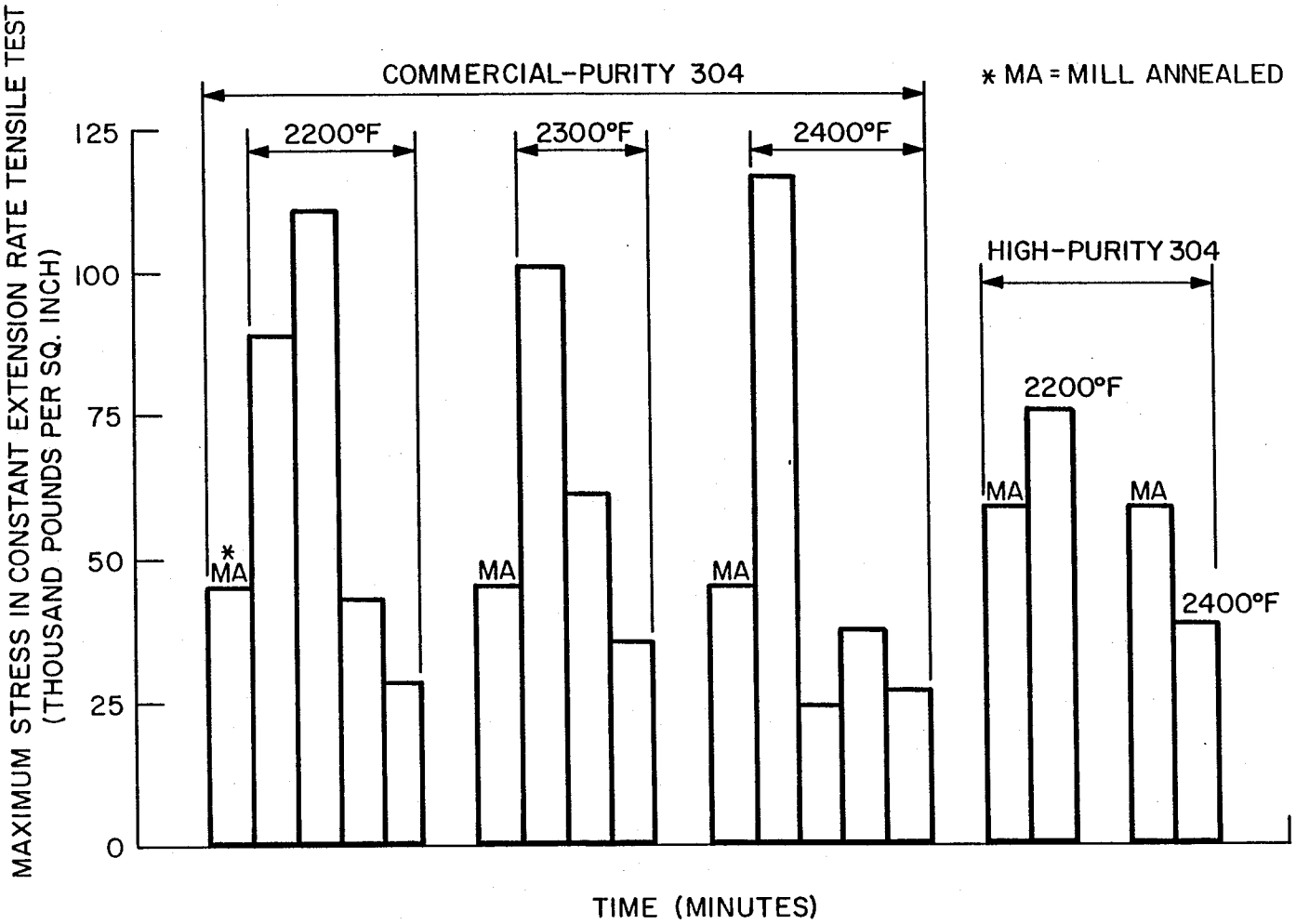
FIG. 3 of the drawing comprises a bar graph showing the relative maximum stress attained in stress corrosion tests of stainless steel subjected to the heat treatment of this invention.

The temperature and time solution annealing conditions of this invention not only eliminate irradiation assisted stress corrosion cracking in austenitic stainless steels, but they also appear to enhance the mechanical properties of such alloys when irradiated. For instance, FIG. 2 of the drawing shows the elongation of commercial purity Type 304 stainless steel subjected to stress corrosion tests increases to peak values in the range from 13 to 16 percent compared to about 0.6 percent for mill annealed, commercial purity Type 304 stainless steel when both are irradiated to a similar fluence. The enhanced ductility resulting from the temperature/time solution annealing would be of significant benefit to designers of components of stainless steel subjected to irradiation since the lower limit of total elongation at 550 F and fluences $>6\times10^{20}$ n/cm$^2$ that is currently used by designers based upon test results from irradiated mill annealed stainless steel is 1.1 percent. Similarly, it is shown in FIG. 3 that the maximum stress (or ultimate tensile strength) attained in the stress corrosion tests increases to peak values ranging from 101 to 117 ksi, compared to 45 ksi for irradiated, mill annealed, commercial purity Type 304 stainless steel.

What is claimed is:

1. A method of inhibiting stress corrosion cracking attributable mainly to exposure to concentrated irradiation in austenitic stainless steel comprising heat treating a stainless steel consisting of an alloy consisting essentially of in approximate percentage by weight:

| | |
|---|---|
| Chromium | 18 to 20 |
| Nickel | 8 to 14 |
| Carbon | 0.08 maximum |
| Manganese | 2.0 maximum |
| Silicon | 1.0 maximum |
| Molybdenum | 3.0 maximum |
| Iron | Balance |

by maintaining the mass of said alloy at a temperature within the range of at least 2050° F. up to about 2400° F. for a period of at least about 1 minute up to about 45 minutes with the period of heat treatment of the alloy being approximately inversely proportional to the temperature of the treatment.

2. The method of inhibiting stress corrosion cracking in austenitic stainless steel of claim 1, wherein the heat treatment comprises maintaining the mass of austenitic stainless steel within a range of about 2200° F. to about 2400° F. for a period of about 1 minute up to about 20 minutes.

3. The method of inhibiting stress corrosion cracking in austenitic stainless steel of claim 1, wherein the stainless steel comprises Type 304.

4. The method of inhibiting stress corrosion cracking in austenitic stainless steel of claim 1, wherein the stainless steel consists of an alloy consisting essentially of in approximate percentage by weight:

| | |
|---|---|
| Chromium | 18 to 20 |
| Nickel | 8 to 12 |
| Carbon | 0.08 maximum |
| Manganese | 2.0 maximum |
| Silicon | 1.0 maximum |
| Iron | Balance |

5. The method of inhibiting stress corrosion cracking in austenitic stainless steel of claim 1, wherein the heat treatment comprises maintaining the mass of single phase, austenitic stainless steel at a temperature of approximately 2300° F. for a period of approximately 1 to 20 minutes.

6. A method of inhibiting stress corrosion cracking attributable mainly to exposure to concentrated irradiation in austenitic stainless steel comprising heat treating a stainless steel consisting of an alloy consisting essentially of in approximate percentage by weight:

| | |
|---|---|
| Chromium | 18 to 20 |
| Nickel | 8 to 12 |
| Carbon | 0.08 maximum |
| Manganese | 2.0 maximum |

-continued

| | |
|---|---|
| Silicon | 1.0 maximum |
| Iron | Balance |

by maintaining the mass of said alloy at a temperature within the range of about 2200° F. to about 2400° F. for a period of about 1 minute up to about 20 minutes with the period of heat treatment of the steel being approximately inversely proportional to the temperature range of the treatment.

* * * * *